United States Patent [19]

Nakamura et al.

[11] 4,297,302

[45] Oct. 27, 1981

[54] BUTTERFLY THROTTLE VALVE WITH A RAISED UPPER LIP

[75] Inventors: Ken Nakamura, Kawasaki; Hiromichi Ofuji, Yokohama; Junichi Yokoyama, Ebina, all of Japan

[73] Assignee: Nissan Motor Company, Limited, Yokohama, Japan

[21] Appl. No.: 81,432

[22] Filed: Oct. 3, 1979

[30] Foreign Application Priority Data

Oct. 7, 1978 [JP] Japan ..... 53-137328[U]

[51] Int. Cl.[3] ..... F02M 3/08

[52] U.S. Cl. ..... 261/65

[58] Field of Search ..... 261/65

[56] References Cited

U.S. PATENT DOCUMENTS

| | | | |
|---|---|---|---|
| 3,057,606 | 10/1962 | Hegna | 261/65 |
| 3,176,704 | 4/1965 | De Palma | 261/65 |
| 3,298,677 | 1/1967 | Anderson | 261/41 D |
| 3,759,499 | 9/1973 | Lang | 261/65 |
| 3,785,628 | 1/1974 | Lang | 261/112 |
| 3,914,350 | 10/1975 | Sang-Yol | 261/65 |
| 4,146,596 | 3/1979 | Saito et al. | 261/65 |

FOREIGN PATENT DOCUMENTS

| | | | |
|---|---|---|---|
| 507977 | 6/1939 | United Kingdom | 261/65 |

*Primary Examiner*—Tim R. Miles

[57] ABSTRACT

In an air-fuel mixture supply device for an internal combustion engine, a butterfly-type throttle valve is disclosed whose upstream face is formed with a raised portion extending around the major of its periphery, but which is broken at least at the middle of the downstream part of the periphery of this upstream face. Thereby distribution of the air-fuel mixture is improved between the cylinders of a multi-cylinder engine.

1 Claim, 18 Drawing Figures

BUTTERFLY THROTTLE VALVE WITH A RAISED UPPER LIP

BACKGROUND OF THE INVENTION

The present invention relates to an air-fuel mixture supply device, and more particularly relates to an air-fuel mixture supply device for an internal combustion engine in which fuel is injected into an air stream upstream of a disk-shaped butterfly type throttle valve which is rotatably mounted in an intake passage.

In an air-fuel mixture supply device such as, for example, a carburetor, with such a throttle valve, when the opening of the throttle valve is relatively small, then small droplets of fuel which impinge on the upstream face of the throttle valve tend to stick thereon, to collect together, and to form larger droplets. As a result, fuel temporarily collects on the upstream face of the throttle valve, and then drips off this edge at random places and times, and may tend to trickle down the wall of the intake passage in liquid form without being properly vaporized. This means that the distribution of fuel to the various cylinders of the engine can be very poor, and they may receive air-fuel mixture of different air/fuel ratio, and this ratio may vary over time as well. As seen from the illustrative graph FIG. 1, which illustrates air/fuel ratio as delivered to the various cylinders of an internal combustion engine with a conventional throttle valve, this distribution, as stated above, can be very uneven, and this leads to poor fuel economy of the engine, poor performance with regard to emissions of pollutants, and uneven running and acceleration. The air/fuel ratios shown in FIG. 1 are measured with 4-cylinder, 2000 cc engine under engine operating conditions of 2,600 r.p.m. and 5 kg-m wherein T represents the average air/fuel ratio, and #1, #2, #3 and #4 represent the air/fuel ratios at the portions at which the exhaust manifold branches are joined.

Even if each cylinder of the engine has a separate air-fuel mixture supply device, these problems are not obviated, because of the variation of air/fuel mixture ratio with time. Therefore even in this case poor engine performance results.

SUMMARY OF THE INVENTION

Therefore, it is the object of the present invention to provide an air-fuel mixture supply device which can provide air-fuel mixture of an even air/fuel ratio, stabilized over both time and between the various cylinders of the engine to which the fuel-air mixture supply device is fitted.

According to the present invention, this object is accomplished by providing, in an air-fuel mixture supply device for an internal combustion engine which has an intake passage into which fuel is supplied, a disk-shaped butterfly throttle valve, mounted on a valve shaft so as to be rotatable in the intake passage below the position where fuel is supplied thereinto, and so as to have an upstream face whose periphery has an upstream part and a downstream part, characterized in that the upstream face is formed with a raised portion extending around the major portion of its periphery, and that no raised portion is formed on the middle of the downstream part of the periphery of the upstream face.

By this provision, especially during slight opening of the throttle valve, a high-speed localized air flow is formed at the middle of the downstream part of the periphery of the upstream face thereof. The fuel, which trickles down the upstream face and is restricted by the raised portion, cannot flow off the upstream face at its portions where it is relatively close to the side wall of the intake passage, but it can only leave the upstream face at the middle of the downstream part of the periphery thereof, which is relatively far from the the side wall. The fuel is introduced into this high-speed localized air flow, and is well and truly atomized and vaporized thereby. Thus the evenness of distribution of air-fuel mixture to the various cylinders of the engine is assured, and also the supply of air-fuel mixture is stabilized over time.

BRIEF DESCRIPTION OF THE DRAWINGS

The present invention will become more clearly understood from the accompanying description of several preferred embodiments thereof, and from the accompanying drawings. Both the description and the drawings, however, are not intended to limit the present invention in any way, but are given for the purpose of illustration and elucidation only. In the drawings.

DESCRIPTION OF THE PREFERRED EMBODIMENTS

Referring to FIGS. 2 to 18, various preferred embodiments of the present invention will now be described.

Figure 2:
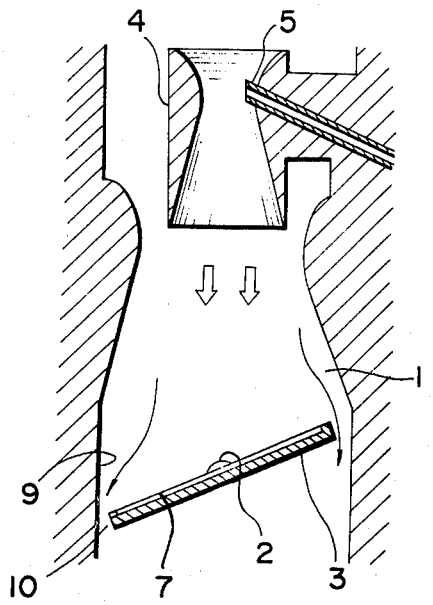
FIG. 2 is an elevational and sectional view of a carburetor incorporating a throttle valve according to the present invention.
Figure 3:
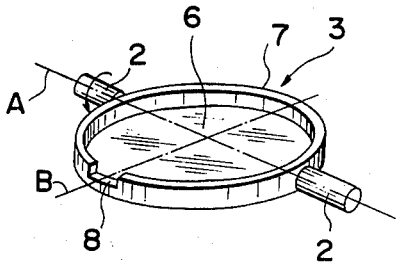
FIG. 3 is a perspective view of the throttle valve of FIG. 2.

FIGS. 2 and 3 show generally a carburetor equipped with a butterfly type throttle valve according to the present invention.

A throttle valve 3 is supported by a shaft 2 in an intake passage 1 which leads to the combustion chambers of an internal combustion engine which is not shown in the figures. Upstream of the throttle valve 3, in a per se well known way, are provided a venturi 4 and a main fuel nozzle 5.

According to the present invention, as best shown in FIG. 3, around the edge of the upstream face of the throttle valve 3 is provided an upwardly projecting rim or lip 7. However, this lip 7 has a recess 8 serving as a flow-out portion in it at its part which is at the middle of the downstream part of the periphery of the throttle valve 3; that is, the part which is moved in the downstream direction when the throttle valve 3 is moved towards its open position. Thus, the line A in FIG. 3 is along the axis of the throttle valve shaft 2, and the line B is perpendicular to line A through the center of the throttle butterfly valve 3, and the flowout portion 8 is situated at the part of the periphery of the throttle valve 3 which intersects the line B on its downstream side.

Thus the throttle butterfly valve 3 has the general appearance of a shallow ashtray.

Thereby liquid droplets which collect on the upstream face 6 of the throttle valve 3 and trickle across it are only able to escape from it by passing through the flow-out portion 8, across which, during the time that the throttle valve 3 is only slightly opened a high-speed current of air is passing through a gap 10 between the side wall 9 of the intake passage 1 and the outer circumferential side surface of the throttle valve 3. Thereby the fuel is well atomized and vaporized. That is, the fuel which has arrived at the flow-out portion 8 is guided or introduced by the high-speed current of air, during which time the fuel is effectively atomized, and flows in the downstream direction of the throttle valve 3, and then is taken into a combustion chamber via an intake manifold (not shown). The droplets are also restrained from trickling down the side wall 9 of the intake passage 1, because when the throttle valve 3 is even slightly opened the gap 8 is well-removed from the side wall 9. Further, the position where the liquid fuel leaves the edge of the throttle valve 3 and escapes into the air stream is stabilized, because it is constrained to be at the downstream side of the gap 8. Thus the trickling of liquid fuel over the side of the throttle valve 3 does not wander from side to side with the passage of time. In other words, the fuel which has impinged on the upper surface of the throttle valve 3 and has been changed into liquid state flows solely from the revolving end of the throttle valve 3 located in the downstream direction thereof, at which end the amount of the air flow flowing toward the center of the intake manifold is largest, whereby the fuel flows downwardly as a constant flow and is uniformly atomized. This further contributes to stabilization of the operation of the engine.

FIGS. 4–17 show other embodiments of the throttle valve of the present invention.

Figure 4:
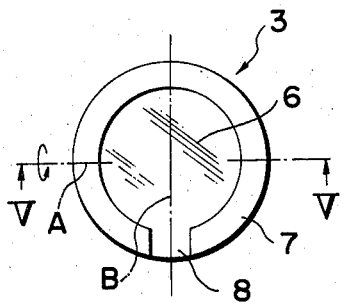
FIG. 4 is a plan view from upstream of another embodiment of the throttle valve of the present invention.
Figure 5:
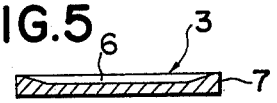
FIG. 5 is a sectional view along the line V—V of FIG. 4.

In the embodiment of FIGS. 4 and 5, the main surface 6 of the upstream face of the throttle valve 3 slopes gently upwards to the raised lip 7.

Figure 6:
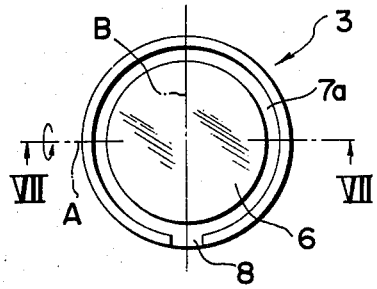
FIGS. 6 and 7, 8 and 9, 10 and 11, 12 and 13, 14 and 15, and 16 and 17 are pairs of views similar to FIGS. 4 and 5, showing other embodiments of the present invention.
Figure 7:
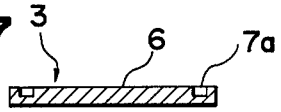
Figure 8:
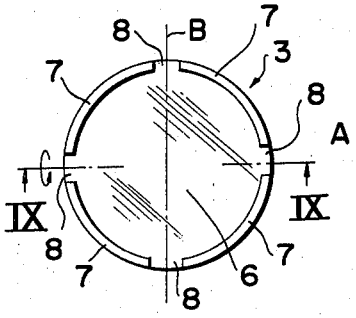

In the embodiment of FIGS. 6 and 7, the raised lip 7 is formed by the part of the upper face of the throttle valve 3 which is outside of a groove 7*a* cut around the periphery thereof, which communicates with a depression 8 serving as the flow-out portion to the outside edge of the throttle valve 3. The top of the lip 7 is the same level as the central part 6 of the throttle valve 3.

The number of places where the lip 7 is not provided around the periphery of the throttle valve 3 is not limited to one. For example, in FIGS. 8 and 9 an embodiment is shown similar to the embodiment of FIGS. 4 and 5, but wherein the lip 7 is formed with gaps at four places around the periphery of the throttle valve 3.

Figure 10:
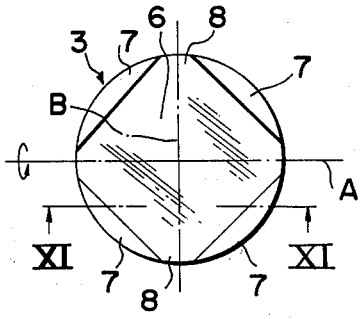
Figure 9:
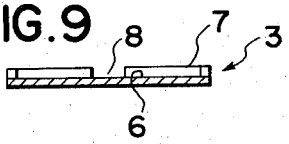
Figure 11:
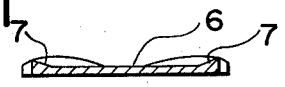

The curve of the lip 7 on its inside periphery is not essential; for example, in FIGS. 10 and 11 an embodiment is shown wherein the inside edge of the lip 7 is formed as four straight portions. This embodiment also, like the embodiment of FIGS. 8 and 9, has four "outlets" where the lip 7 is not present at all around the edge of the throttle valve 3. Like the embodiment of FIGS. 4 and 5, furthermore, this embodiment has a gently sloping surface joining the top of the raised lip 7 to the main surface of the upstream face of the throttle valve, which is designated by 6.

Figure 12:
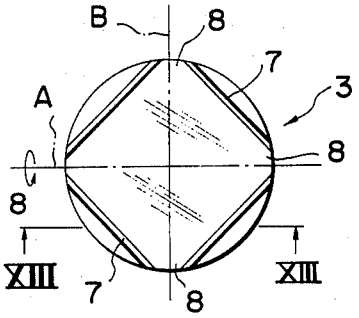
Figure 13:
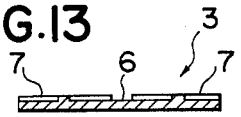

The embodiment of FIGS. 12 and 13 is similar to this last described embodiment, except that the outside portions of the thicker parts of the lip 7 have been removed.

Figure 14:
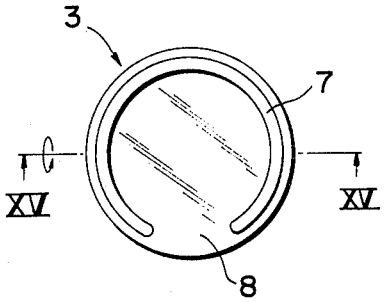
Figure 15:
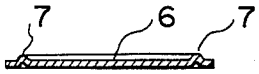

FIGS. 14 and 15 show an embodiment in which the lip 7 is formed by pressing the body of the throttle valve. This embodiment is similar in its function to the embodiment of FIG. 3, although its structure is different.

Figure 16:
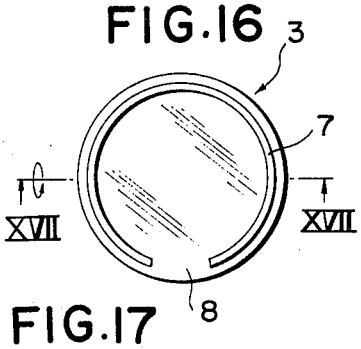
Figure 17:
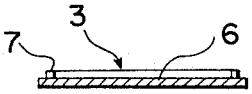

Finally, FIGS. 16 and 17 show an embodiment which is similar in its function to the embodiment of FIG. 3, but in which the lip 7 is formed by a separate member which is welded to the upper face of the throttle valve 3.

Figure 1:
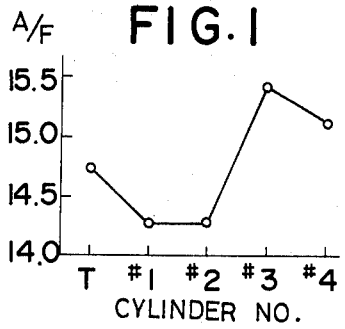
FIG. 1 is a graph showing the distribution of air-fuel mixture to various cylinders of a multi-cylinder internal combustion engine, in terms of the air/fuel ratio received by them, when a conventional butterfly type throttle valve is used.
Figure 18:
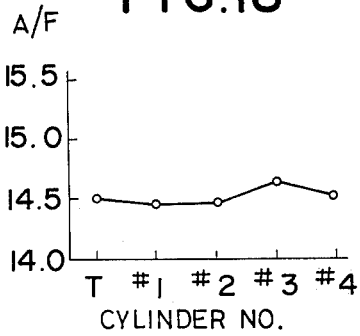
FIG. 18 is a graph similar to FIG. 1, showing the distribution of air-fuel mixture to the various cylinders of an internal combustion engine using a throttle valve according to the present invention.

FIG. 18 shows how a throttle valve of the present invention can even out the supply of air-fuel mixture to the various cylinders of an internal combustion engine, wherein the air/fuel ratios shown in FIG. 18 are measured under the same measuring condition as that of FIG. 1. The improvement in performance obtained by such regularization and standardization of the air/fuel ratio of the mixture are easily apparent to one skilled in the art.

Although the invention has been shown and described with reference to some preferred embodiments thereof, it should not be considered as limited to these, however, or mere and simple generalizations, or other detailed embodiments; yet further changes, modifications, and omissions to the form and the content of any particular embodiment to the form and the content of any particular embodiment might be made by one skilled in the art, without departing from the scope of the invention, and it is therefore desired that the said scope, and the protection granted by Letters Patent, should be defined solely by the accompanying claims, which follow.

What is claimed is:

1. In an air-fuel mixture supply device for an internal combustion engine having an intake passage into which fuel is supplied: a disk-shaped butterfly throttle valve rotatably mounted on a valve shaft in the intake passage below the position where fuel is supplied thereinto, said throttle valve having an essentially flat upstream face which has an upstream part and a downstream part, a groove formed in said essentially flat upstream face and extending adjacent the entire outer periphery of said throttle valve essentially parallel to said outer periphery of the throttle valve; and an outlet passage formed on said downstream part of said upstream face and extending from said groove to the outer periphery, whereby fuel trickling onto the upstream face of said throttle is directed into said groove and guided to the downstream part of said upstream face and discharged to air flow passing through a clearance formed between the inner periphery of said intake passage and the downstream part of said throttle valve to be effectively atomized.

* * * * *